United States Patent [19]

Watanabe

[11] Patent Number: 5,062,888

[45] Date of Patent: Nov. 5, 1991

[54] METHOD OF PRODUCING PRECIPITATE OF RARE EARTH FERROMAGNETIC ALLOY

[75] Inventor: Shunji Watanabe, Tokyo, Japan

[73] Assignee: Seiko Instruments Inc., Japan

[21] Appl. No.: 489,699

[22] Filed: Mar. 7, 1990

[30] Foreign Application Priority Data

Mar. 7, 1989 [JP] Japan ..... 1-54497

[51] Int. Cl.[5] ..... H01F 1/06

[52] U.S. Cl. ..... 75/739

[58] Field of Search ..... 75/739

[56] References Cited

U.S. PATENT DOCUMENTS 3,663,318 5/1972 Little ..... 75/739

4,097,313 6/1978 Tokuoka ..... 75/739

*Primary Examiner*—Peter D. Rosenberg

*Attorney, Agent, or Firm*—Bruce L. Adams; Van C. Wilks

[57] ABSTRACT

An aqueous solution containing reducing agent such as potassium borohydride or sodium borohydride is added with another solution containing salt of an iron-triads-group element and salt of a rare earth element to conduct reaction to effect reduction to the iron-triads-group metal and the rare earth metal to thereby produce fine powder of rare earth magnet composed of alloy of the iron-triads-group metal and the rare earth metal.

12 Claims, 5 Drawing Sheets

GRAPH SHOWING X-RAY DIFFRACTION RESULTS OF PRECIPITATE

METHOD OF PRODUCING PRECIPITATE OF RARE EARTH FERROMAGNETIC ALLOY

BACKGROUND OF THE INVENTION

The present invention relates to a method of producing fine powder of rare earth magnet.

As the conventional method of a producing a rare earth magnet fine powder composed of an alloy of an iron-triads-group metal and a rare earth metal, there have been known a method of making an ingot of mother alloy and then crushing the same, or another method of making a ribbon of mother alloy by instant quenching of molten alloy and then crushing the same. Further, a chemical reaction method of producing alloy powder has been studied by Saita et al. of Tohoku University (Special Working Group in method of making amorphous metalization and application thereof, The ninth regular meeting text, 28); however, the production of rare earth magnet powder has not been reported.

For making and crushing an ingot or for making a ribbon by instant quenching of molten alloy and crushing the same so as to produce fine powder of a rare earth magnet, there has been needed high energy consumption, complicated processes and expensive equipments such as a big furnace, liquid instant quenching apparatus and crushing machine, thereby causing the problem of high production cost.

SUMMARY OF THE INVENTION

An object of the present invention is to therefore produce fine powder of a rare earth magnet at reduced production cost.

According to the inventive practically simple method of adding an aqueous solution containing a salt of an iron-triads-group metal and a salt of a rare earth metal to another aqueous solution containing reducing agent such as potassium borohydride or sodium borohydride, fine power of rare earth magnet can be produced, thereby reducing the production cost and simplifying the process as compared to the conventional methods.

When reducing aqueous solution of $MSO_4$ and $RCl_3$ by potassium borohydride, reactions concurrently occur as represented by the following formulas:

$$2MSO_4+KBH_4+2H_2O \rightarrow 2M+2H_2+2H_2SO_4+KBO_2 \quad (1)$$

$$4MSO_4+2KBH_4 \rightarrow 2M_2B+K_2SO_4+4H_2 \quad (2)$$

$$2RCl_3+KBH_4+2H_2O \rightarrow 2R+H_2+6HCl+KBO_2 \quad (3)$$

$$4RCl_3+3KBH_4 \rightarrow R_4B_3+14KCl+6H_2 \quad (4)$$

where M: iron-triads-group element (Fe, Ni or Co) and R: rare earth element.

The reactions are theoretically represented by the above formulas, and actually the resulting substance is composed of R-M-B alloy according to eutectoid mechanism in a manner similar to electroless plating. These reduction reactions occur instantly to suppress crystal growth to thereby precipitate fine powder of the R-M-B alloy. Therefore, the fine powder of the R-M-B alloy can be produced directly in contrast to the conventional methods in which ingot or ribbon of the alloy is crushed.

DETAILED DESCRIPTION OF THE INVENTION

Hereinafter, the a description is given for embodiments of the present invention.

Embodiment 1

Fine powder of Nd-Fe-B alloy was produced by the following method. Namely, drops of aqueous solution containing $FeSO_4$ and $NdCl_3$ were added into aqueous solution of potassium borohydride to effect reduction reaction to precipitate fine powder of Nd-Fe-B alloy. The precipitated substance was filtered by a glass filter, then washed sequentially by distilled water, methanol and acetone, and thereafter dried in vacuum together with the glass filter.

Concentration of Reducing Agent

Figure 1:
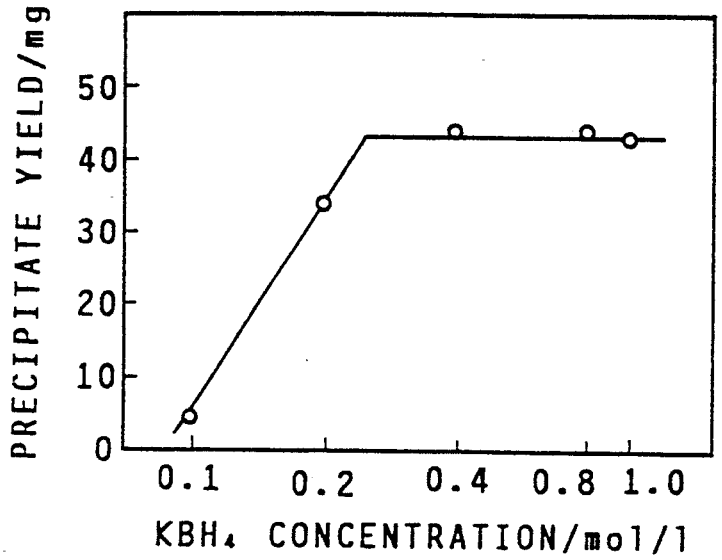
FIG. 1 is a diagram showing the relation between reducing agent concentration and yield of precitiptate according to the inventive method.

A 2.0 ml of aqueous solution containing $FeSO_4$ and $NdCl_3$ at mole ratio of 8:2 by concentration of 0.2 mol/l was added to 2.0 ml of aqueous solution containing potassium borohydride at different concentrations of 0.2, 0.4, 0.8, 1.6 and 2.0 mol/l to produce fine powder of Nd-Fe-B alloy in order to determine the optimum range of the concentration of the reducing agent. FIG. 1 shows the relation between concentration of the reducing agent and yield of the precipitate. As shown in the figure, whole of Nd ions and Fe ions contained in the aqueous solution of $FeSO_4$ and $NdCl_3$ was entirely reduced when the concentration of the reducing agent was more than about 0.5 mol/l. This concentration value is about five times as great as the theoretical value calculated according to the chemical reaction formulas.

Figure 2:
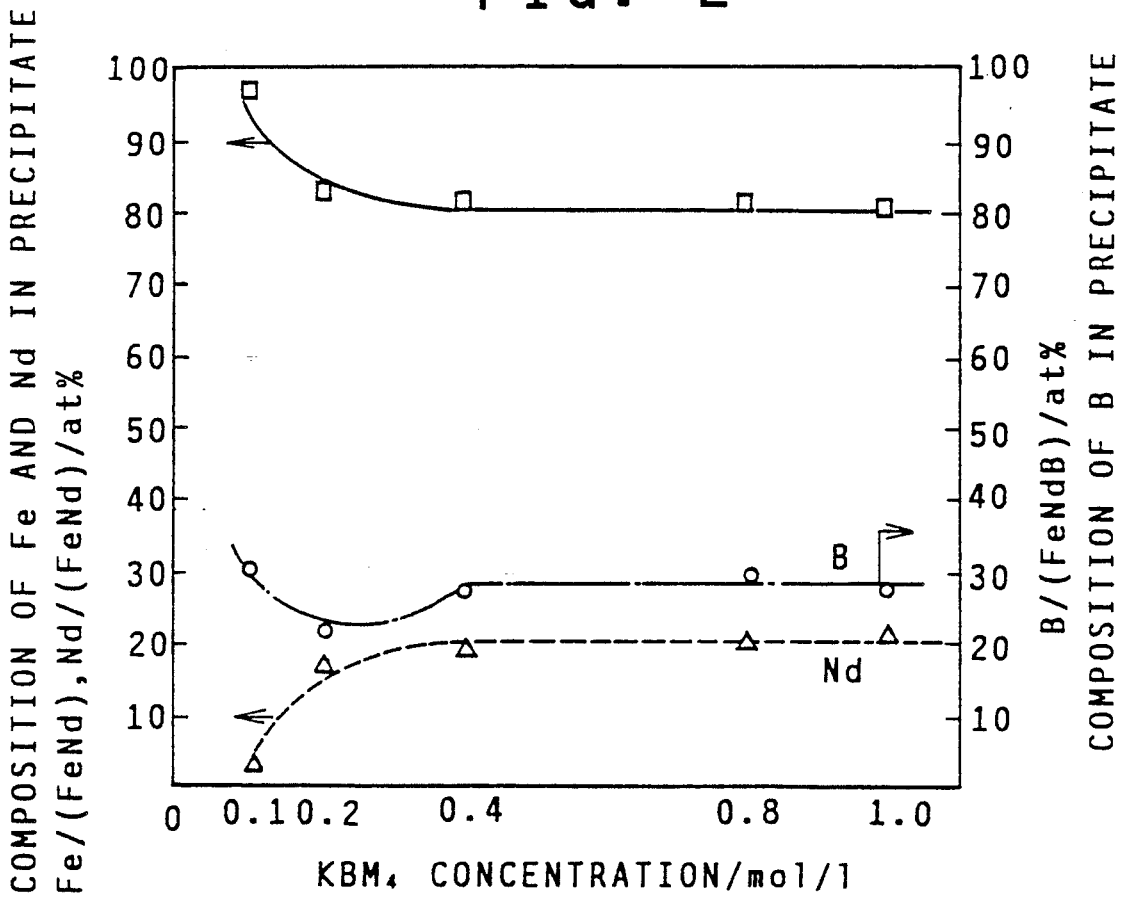
FIG. 2 is a diagram showing reducing agent concentration and composition of precipitate according to the inventive method.

FIG. 2 shows the relation between the concentration of reducing agent and the composition of precipitate, which are measurement results obtained by plasma luminescence spectroanalyzer. It was found that stable composition of the precipitate was not obtained in lower range of the reducing agent concentration. In view of the above fact and taking in into account degradation of the reducing agent, the concentration should be set eight to twenty times as much as the calculated value for safety.

Composition of Precipitate

Figure 3:
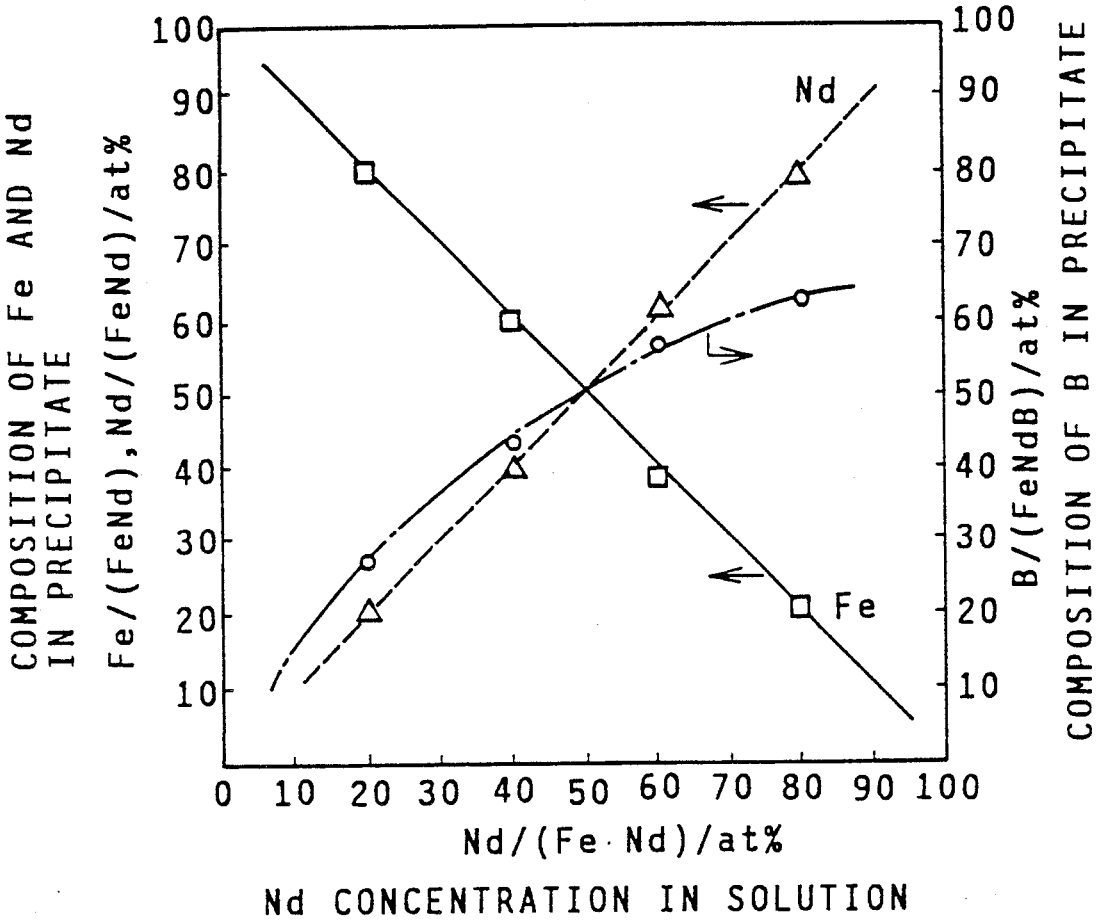
FIG. 3 is a diagram showing the relation between solution composition and precipitate composition according to the inventive method.

A 2.0 ml of aqueous solution containing by concentration of 0.2 mol/l $FeSO_4$ and $NdCl_3$ at different mole ratios of 8:2, 4:6, 6:4 and 2:8 was added to 2.0 ml of aqueous solution containing potassium borohydride by concentration of 2.0 mol/l to produce fine powder of Nd-Fe-B alloy. The composition of precipitate was measured by the plasma luminescence spectroanalyzer, the results of which are shown in FIG. 3. According to the results, the ratio of Nd and Fe of the precipitate corresponds to that of $FeSO_4$ and $NdCl_3$ in the solution. The boron amount in the precipitate increases proportionally to the Nd amount in the precipitate.

Microstructure of Precipitate

Figure 4:
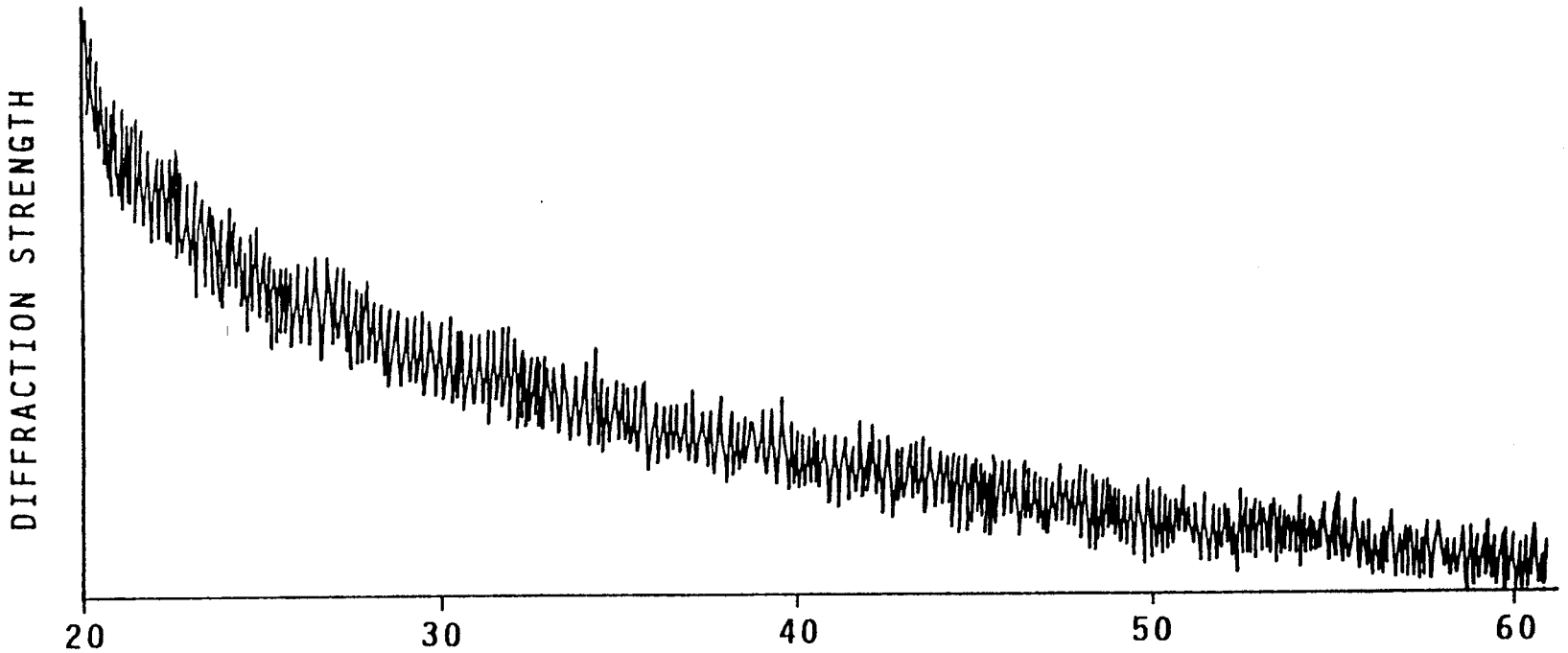
FIG. 4 is a diagram showing measurement results, by X-ray diffraction, of microstructure of precipitate according to the inventive method.

A 2.0 ml of aqueous solution containing by concentration of 0.2 mol/l $FeSO_4$ and $NdCl_3$ at mole ratio of 8:2 was added to 2 ml of aqueous solution containing potassium borohydride by concentration of 2.0 mol/l to produce fine powder of Nd-Fe-B alloy. Microstructure of the precipitate was measured by an X-ray diffraction device, the result of which is shown in FIG. 4. In the figure, rising of the graph on left side is due to the glass filter which was utilized to filter the fine powder of Nd-Fe-B alloy. In the X-ray diffraction, any peak indicative of crystal lattice was not detected. Therefore, it was found that Nd-Fe-B alloy has amorphous microstructure.

Particle Diameter of Precipitate

Figure 5:
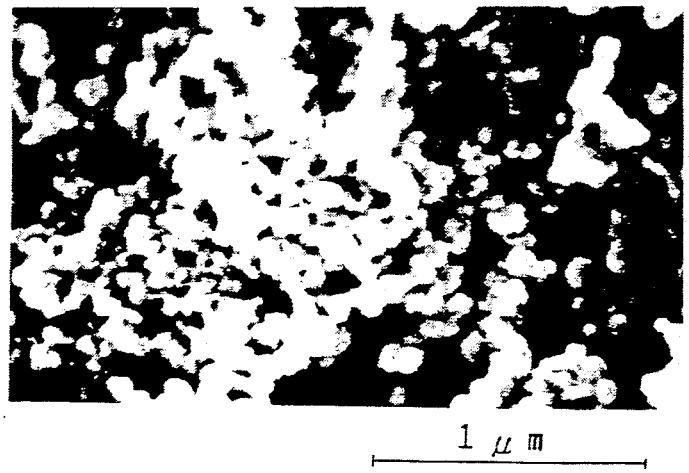
FIG. 5 is a photograph, taken by scanning electron microscope, of precipitate according to the inventive method.

A 2.0 ml of aqueous solution containing by concentration of 0.2 mol/l $FeSO_4$ and $NdCl_3$ was added to 2 ml of solution containing potassium borohydride by concentration of 2.0 mol/l to produce fine powder of Nd-Fe-B alloy. Particle diameter of the precipitate was measured by a scanning electron microscope, the measurement results of which are shown in FIG. 5. The particle diameter is more or less 0.1 μm and is substantially uniform.

In the above described embodiment, the fine powder of Nd-Fe-B alloy was produced such that it has Fe composition in the range of 0–95 at %, Nd composition in the range of 0–95 at % and B composition in the range of 5–65 at %, and it has particle diameter of more or less 0.1 μm.

Embodiment 2

Various kinds of neodymium salt and iron salt were utilized as listed in Table 1. A 2.0 ml of aqueous solution containing by concentration of 0.2 mol/l neodymium salt and iron salt at the mole ratio of 8:2 was added to 2.0 ml of aqueous solution containing potassium borohydride by concentration of 2.0 mol/l to produce fine powder of Nd-Fe-B alloy. The obtained fine powder has substantially uniform particle diameter of more or less 0.1 μm, and has amorphous microstructure as confirmed by X-ray diffraction measurement results.

TABLE 1

| Neodymium salts | iron salts |
|---|---|
| $NdF_3$ | $FeCl_2$ |
| (dissolved into sulfuric acid) | $FeCl_3$ |
| and then diluted by water) | $FeSO_4.nH_2O$ |
| $NdI_3$ | $Fe_2(SO_4)_3.nH_2O$ |
| $Nd_2(SO_4)_3.nH_2O$ | $Fe(NO_3)_2.nH_2O$ |
| $Nd(NO_3)_3.nH_2O$ | $Fe(NO_3)_3.nH_2O$ |
| $Nd_2(CH_3COO)_3.H_2O$ | $FeBr_2.nH_2O$ |
| $Nd_2O_3$ | $FeBr_3.nH_2O$ |
| (dissolved into diluted | $FeI_2.nH_2O$ |
| hydrochloric acid) | $Fe(CH_3COO)_2.nH_2O$ |

Embodiment 3

Figure 6:
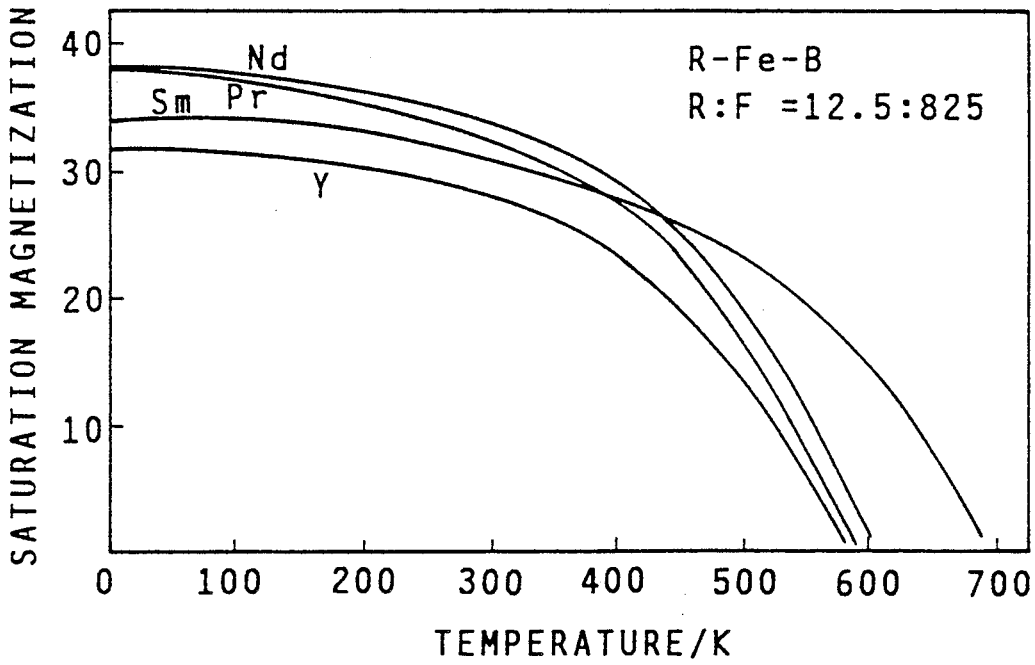
FIG. 6 is a diagram showing temperature dependence of saturation magnetization of rare earth magnet obtained according to the inventive method.

Fine powder of R-Fe-B alloy having the composition ratio of rare earth and iron 12.5:87.5 was produced using various salts of rare earth elements listed in Table 2. The obtained fine powder of R-Fe-B alloy was compacted or press-formed under a magnetic field, then sintered within argon gas at 1000° C. for one hour and quickly cooled to the room temperature, and thereafter treated by aging process at 600° C. to thereby produce a tablet of R-Fe-B alloy magnet. FIG. 6 shows temperature dependence of saturation magnetization of the magnet.

TABLE 2

| Rare earth elements |
|---|
| $NbCl_3.nH_2O$ |
| $PrCl_3.nH_2O$ |
| $SmCl_3.nH_2O$ |
| $YCl_3.nH_2O$ |

As described above, according to the present invention, fine powder of a rare earth magnet can be easily and industrially produced without crushing ingot or ribbon material.

What is claimed is:

1. A method of producing ferromagnetic powder, comprising the steps of:
   preparing a solution containing a reducing agent which has a boron element, an iron-triads-group element ion, and a rare earth element ion; and
   precipitating ferromagnetic powder composed of an alloy of iron-triads-group metal, rare earth metal and boron.

2. A method according to claim 1; wherein the reducing agent is selected from potassium borohydride and sodium borohydride.

3. A method according to claim 1; wherein the rare earth element ion is selected from Nd ion, Pr ion, Sm ion and Y ion.

4. A method of producing ferromagnetic powder suitable for use in forming a rare earth magnet, comprising the steps:
   preparing an aqueous solution containing a salt of Fe, Ni or Co, a salt of a rare earth metal and a boron-containing reducing agent; and
   precipitating from the aqueous solution ferromagnetic powder composed of an alloy of Fe, Ni or Co, rare earth metal and boron.

5. A method of producing ferromagnetic powder suitable for use in forming a rare earth magnet according to claim 4; wherein the reducing agent comprises a borohydride.

6. A method of producing ferromagnetic powder suitable for use in forming a rare earth magnet according to claim 5; wherein the borohydride comprises potassium borohydride or sodium borohydride.

7. A method of producing ferromagnetic powder suitable for use in forming a rare earth magnet according to claim 6; wherein the rare earth metal comprises Na, Pr, Sm or Y.

8. A method of producing ferromagnetic powder suitable for use in forming a rare earth magnet according to claim 5; wherein the rare earth metal comprises Na, Pr, Sm or Y.

9. A method of producing ferromagnetic powder suitable for use in forming a rare earth magnet according to claim 4; wherein the rare earth metal comprises Na, Pr, Sm or Y.

10. A method of producing ferromagnetic powder suitable for use in forming a rare earth magnet according to claim 4; wherein the ferromagnetic powder has a substantially uniform particle diameter.

11. A method of producing ferromagnetic powder suitable for use in forming a rare earth magnet according to claim 10; wherein the particle diameter is on the order of 0.1 $\mu$m.

12. A rare earth magnet comprised of compacted ferromagnetic powder produced by the method of claim 4.

* * * * *